US006084600A

United States Patent [19]

Munshi

[11] Patent Number: 6,084,600

[45] **Date of Patent: *Jul. 4, 2000**

[54] METHOD AND APPARATUS FOR HIGH-SPEED BLOCK TRANSFER OF COMPRESSED AND WORD-ALIGNED BITMAPS

[75] Inventor: Aaftab A. Munshi, San Jose, Calif.

[73] Assignee: Micron Technology, Inc., Boise, Id.

[ * ] Notice: This patent issued on a continued prosecution application filed under 37 CFR 1.53(d), and is subject to the twenty year patent term provisions of 35 U.S.C. 154(a)(2).

[21] Appl. No.: 08/619,815

[22] Filed: Mar. 15, 1996

[51] Int. Cl.[7] ..... G09G 5/36

[52] U.S. Cl. ..... 345/509; 345/511; 345/202

[58] Field of Search ..... 345/189, 190, 345/191, 192, 200, 507, 509, 515, 516, 202, 510, 508, 511; 382/244, 245, 246, 247

[56] References Cited

U.S. PATENT DOCUMENTS

| | | | |
|---|---|---|---|
| 4,967,378 | 10/1990 | Rupel et al. | 345/510 |
| 5,016,191 | 5/1991 | Radochonski | 364/518 |
| 5,150,312 | 9/1992 | Beitel et al. | 345/473 |
| 5,416,499 | 5/1995 | Ohtsu | 345/189 |
| 5,559,953 | 9/1996 | Seiler et al. | 395/164 |
| 5,590,260 | 12/1996 | Morse et al. | 395/167 |
| 5,670,993 | 9/1997 | Greene et al. | 345/509 |
| 5,706,483 | 1/1998 | Patrick et al. | 345/515 |

*Primary Examiner*—Dennis-Doon Chow
*Attorney, Agent, or Firm*—Blakely, Sokoloff, Taylor & Zafman LLP

[57] ABSTRACT

Graphics display performance is significantly improved by compressing pixel information, by aligning the 8, 16 or 32 bit pixels transferred over a 32-bit Peripheral Component Interface (PCI) bus with the pixels in the display memory, and by avoiding moves of pixel data within display memory. Compression is achieved by not transferring data for pixels that are not modified by the transfer. Rather, a count of unmodified pixel bytes to skip precedes each set of pixel data for contiguous pixels that are modified. Alignment is achieved by ensuring that the boundaries between words within the pixel set transferred matches those within the corresponding target pixels in the display memory. This alignment significantly speeds up modifying pixel data within the display memory. The burden of ensuring this alignment is placed on the applications software that initiates the transfer. For a static image, such as a cockpit, this alignment can be achieved at the time that the image information used by the software is compiled into a bitmap. For a dynamic image, such as a sprite, this alignment can be achieved by compiling all possible word alignments of the sprite's pixel data into different bitmap versions. At run time, the applications software uses the sprite's current location to dynamically select which bitmap version to transfer. In one embodiment, a graphics accelerator interprets the bitmap transferred and updates display memory accordingly. In another embodiment, software executing on the host CPU directly writes pre-aligned pixel data into the display memory.

28 Claims, 7 Drawing Sheets

METHOD AND APPARATUS FOR HIGH-SPEED BLOCK TRANSFER OF COMPRESSED AND WORD-ALIGNED BITMAPS

FIELD OF THE INVENTION

The present invention relates to the display of graphical information under the control of a digital computer. In particular, it relates to speeding up block transfers of pixel data (bitblits) by compressing and word aligning the data transferred.

BACKGROUND OF THE INVENTION

Digital systems such as computers that display graphical information typically divide the image area displayed to the user into picture elements or pixels. The image displayed is often a rectangular array ranging from 320 pixels wide (or pixels per line) by 240 pixels high (or lines per frame) to 1280 by 1024 pixels.

If each pixel is either on or off, then only one bit of information need be stored per pixel. Typically, multiple colors or gray shades are supported, using a frame buffer or display memory of 8, 16 or 32 bits per pixel.

A problem arises in updating the pixel information in the display memory in a timely manner. If the host processor or central processing unit (CPU) of the computer system updates the display memory directly, then a data communications channel or bus with a substantial bandwidth must be provided between them. For example, if the target specification is for each pixel in a 1280 by 1024 display to be rewritten or transferred 30 times per second to provide for smooth motion, then a transfer bandwidth of approximately 42 million bits per second is required.

Such high bandwidth is expensive, both for the bus and for the memory device or CPU to store or generate the information being updated. Even a more modest example still requires substantial bandwidth: a 640 by 480 image of 8-bit pixels can be completely rewritten in about ½ second using 5 million bits per second. Prior art systems attempt to reduce this bandwidth requirement.

One way in which bandwidth can be reduced is to transfer only pixel information for pixels being displayed. It is possible, for example, to only transfer the pixel data and address of the pixels that have changed. However, this approach often has a drawback in that transferring an individual pixel may involve a read-modify-write operation.

Multiple pixels are often packed into a single memory or bus word. It is common for 8-bit pixels to be packed 2 per 16 bit word or 4 per 32 bit word, and for 16-bit pixels to be packed 2 per 32 bit word. To modify a single pixel in these cases, the previous contents of the display memory word must be read and the data for the unchanged pixels within that word must be rewritten along with the data for the changed pixel.

Another way in which the bandwidth required can be reduced is known as a bit block transfer or bitblit operation. In a bitblit, a rectangular region within the display memory is specified and data for pixels within the region is transferred. However, analogous problems often arise with this approach.

If the first and last pixels in the set being transferred, or in each line of the rectangle being transferred, do not happen fall on a word boundary, then the above read-modify-write cycle must be used for the display memory words that begin and end the set, or that begin and end each line of the rectangle. But unless the word boundaries within the pixel set happen to line up between the source of the modified pixels and the display memory, then transferring even the internal words requires that pixels be shifted within words.

Another way in which the bandwidth required can be reduced is known as run length encoding. In a run length encoded bitmap, a count of pixels is provided along with a single copy of the pixel data that is to be written into a contiguous set of pixels, where the length of that set is given by the pixel count. The CPU and the bus between the CPU and the display memory can be relieved of the burden of interpreting and transferring such bitmaps by having a graphics processor or accelerator accept such bitmaps from the host and update the display memory according to the run lengths that are encoded in the bitmap.

Yet another way in which the bandwidth required can be reduced is known as chroma key encoding. In a chroma key encoded bitmap, the image overlay being written into the display memory is transparent for a particular pixel. That is, pixel data transferred does not indicate a new color to be written into the pixel addressed. Thus, the graphics accelerator does not alter the pixel data within the display memory for any pixels that are so encoded in the bitmap. Typically, the particular value used as the chroma key is programmable by the applications software running on the host computer and interpreted by the graphics accelerator.

Both run length encoding and chroma key encoding suffer from the drawback that pixel data is transferred even for pixels that are unchanged. Additionally, both run length encoding and chroma key encoding suffer from the drawback that significant additional processing is often required when the pixel data transferred does not have word boundaries that align with those of the corresponding pixels in the display memory. This additional processing includes a possible read-modify-write operation at the boundaries of the set being transferred and a possible realignment of pixel data within words for all the pixels being transferred.

Still another way in which the bus and processor bandwidth required can be reduced is to have a display memory that is larger than is required to hold pixel data for the rectangular region or window being displayed. Non-displayed portions of display memory can hold bitmaps. The graphics accelerator can move these bitmaps into the display window when commanded to do so by software executing on the host CPU. However, this approach can create a performance bottleneck at the display memory because at least two access cycles are required for each word moved.

Thus, there is a need for a way to reduce the bandwidth and processing required when updating only some of the pixels within a display memory.

SUMMARY OF THE INVENTION

The present invention is a method and apparatus for fast transfers of pixel data from a high-speed bus into a frame buffer or display memory. The graphics display performance of the present invention is significantly improved over the prior art. This is achieved partly by compressing the pixel information transferred, partly by word aligning the pixels in the information transferred with the corresponding pixels in the display memory, and partly by avoiding transfers within display memory.

The pixel data transferred is compressed in that no pixel data is transferred for pixels that are unmodified by the transfer. Rather, a count of unmodified pixel bytes to skip precedes each set of pixel information for modified pixels.

The pixel data transferred is aligned such that the boundaries between words within each set of contiguous pixels transferred matches those within the corresponding pixels stored in the display memory, i.e. those pixels at the target address of the transfer. This word alignment significantly speeds up the graphics accelerator's task of modifying the pixel data within the display memory. This speed-up is achieved at the cost of placing the burden of ensuring this alignment on the applications software that initiates the transfer.

In the case of a static image, such as a cockpit, the alignment required can be achieved at the time that the image information used by the software is compiled into a bitmap.

In the case of a dynamic image, such as a sprite, the alignment required can be achieved by compiling all possible word alignments of the sprite's pixel data into different bitmap versions. At run time, the applications software uses the sprite's current location to dynamically select which version of the sprite's bitmap to transfer.

The pixel data is transferred into the display memory from the main memory, rather than being transferred from one location in display memory (such as a location outside of the current display window) to another (such as a location within the current display window). Transfers within display memory require that the display memory be both read and written—that is, at least two memory access cycles are always required per each word transferred. Transfers from the high-speed bus into the display memory can be faster in that only one memory access cycle may be required per each word transferred.

The bitmaps are stored in the main memory. The bitmaps may be put on the high-speed bus during a write operation of the host CPU into a first-in-first-out (FIFO) register in the graphics accelerator. The bitmaps may also be put on the high-speed bus by a direct memory access (DMA) transfer that is initiated by, but then runs independently of, the host CPU software. One embodiment of the graphics accelerator includes 1 MB to 4 MB of display memory and is implemented using a pipelined architecture.

In another embodiment of the present invention, software executing on the host CPU directly writes pre-aligned pixel information to the display memory. In this embodiment, a graphics accelerator is optional.

BRIEF DESCRIPTION OF THE DRAWINGS

The present invention is illustrated in the following drawings, in which known circuits are shown in block-diagram form for clarity. These drawings are for explanation and for aiding the reader's understanding. The present invention should not be taken as being limited to the preferred embodiments and design alternatives illustrated.

FIG. 3(*b*) shows the four possible alignments of a set of contiguous 8-bit pixels within a 32-bit display memory.

DETAILED DESCRIPTION OF THE INVENTION

Overview

Disclosed herein are various alternative embodiments and design alternatives of the present invention which, however, should not be taken as being limited to the embodiments and alternatives described. One skilled in the art will recognize alternative embodiments and various changes in form and detail that may be employed while practicing the present invention without departing from its principles, spirit or scope.

In particular, the embodiments of the present invention described herein are designed to operate in a personal computer system, with a high-speed bus, specifically the 32-bit industry-standard peripheral component interface (PCI) bus and an Intel-compatible Pentium® (or higher) host CPU. The PCI bus links the host CPU with one or more user input devices, one or more storage devices and with a graphics accelerator or a frame buffer display memory. Pixel depths of 8, 16 or 32 bits per pixel are supported. Design details have been optimized to support game applications software. It will be clear to one skilled in the art that there are numerous other alternative designs that do not depart from the spirit or scope of the present invention.

Figure 1:
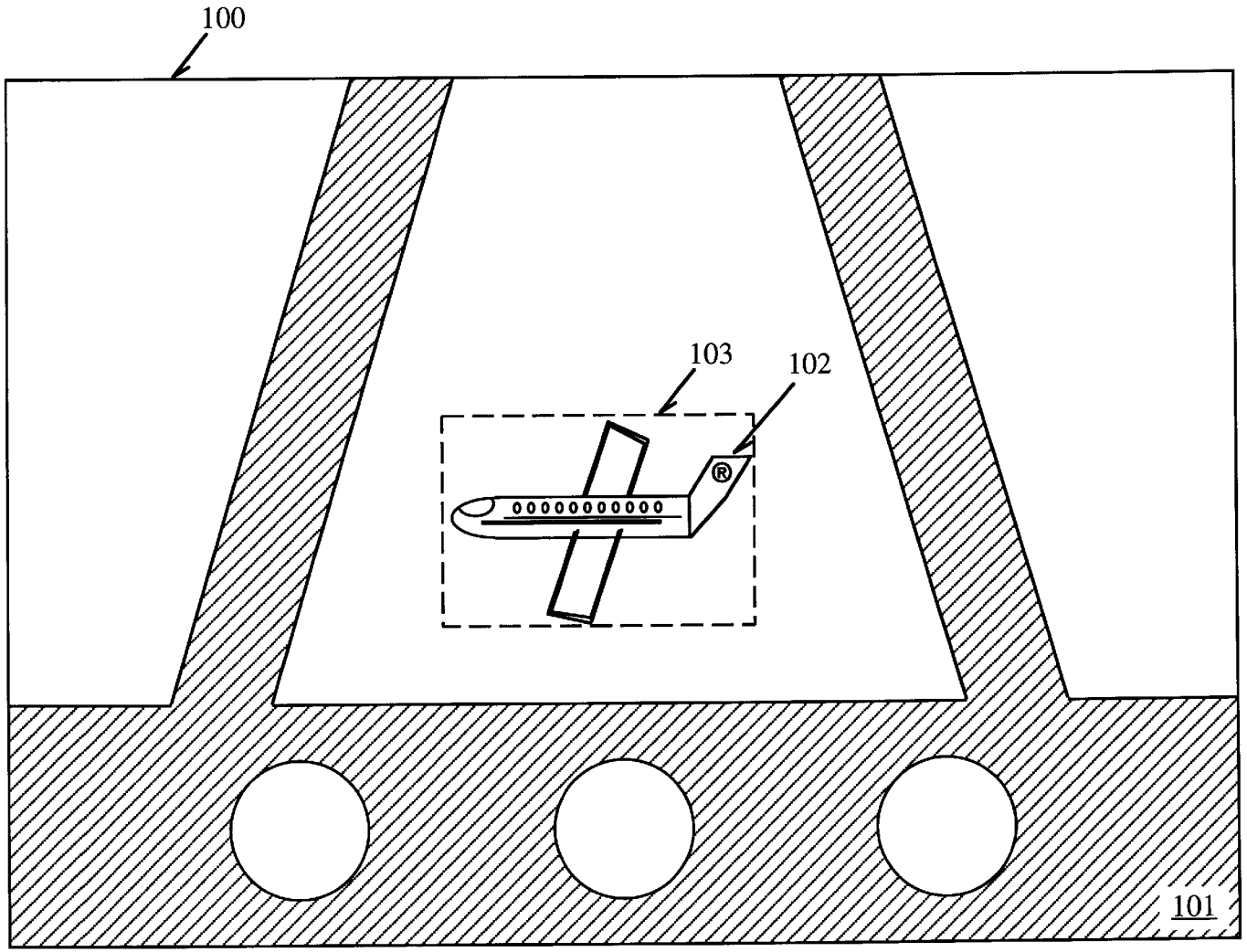
FIG. 1 illustrates two types of graphical objects or bitmaps which the present invention efficiently supports, a moving sprite and a stationary cockpit.

FIG. 1 shows how cockpit 101 and sprite 102 appear to the computer system user on screen 100. "Cockpit" is the name given to a bitmap that stays stationary on the display screen. "Sprite" is the name given to a bitmap that appears at various positions on the display screen.

In the particular cockpit shown in FIG. 1, there are three angular regions and three circular regions that are transparent. When writing cockpit 101 to a graphics display memory, the current values of these transparent pixels within cockpit 101 must be left unchanged. Similarly, sprite 102 consists of both colored or opaque and transparent pixels within bounding box 103. Again, transparent pixels must be left unchanged when sprite 102 is written to display memory.

Format of Fast Transfer Bitmap

Figure 2A:
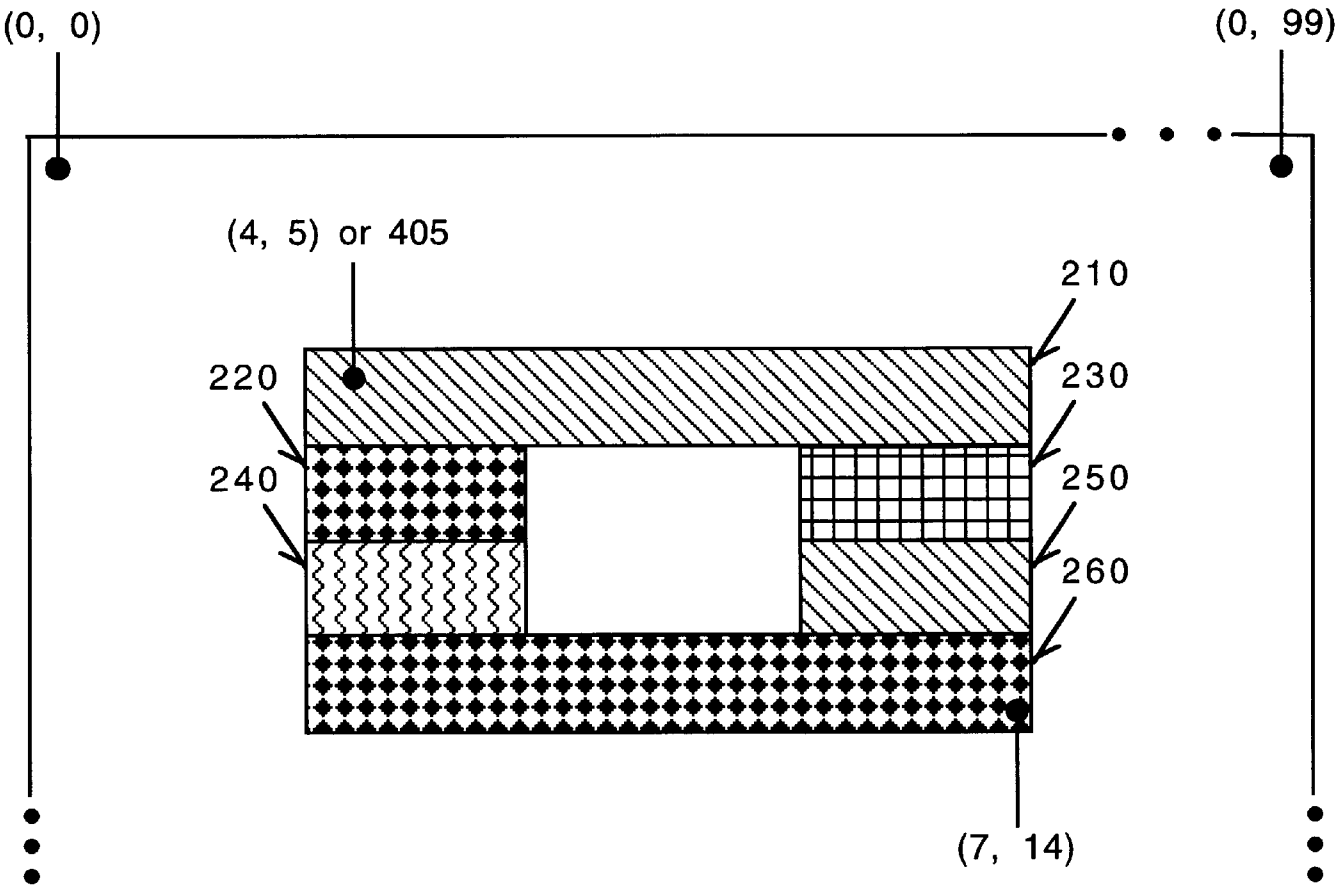
FIG. 2*a* shows how an example bitmap is displayed to the user, according to the present invention.

FIG. 2*a* shows how a particular example bitmap appears on the screen. The first pixel of the bitmap is located at (4, 5), that is at line 4, pixel 5. Note that in this particular example, the display screen starts with line 0, pixel 0 in the upper left comer, and continues to line 0, pixel 99 in the upper right corner, giving 100 pixels per line. The example bitmap shown in FIG. 2*a* is a rectangle that is 4 lines high and 10 pixels wide. Off center in the rectangle is a transparent region that is 2 lines high and 4 pixels wide.

Figure 2B:
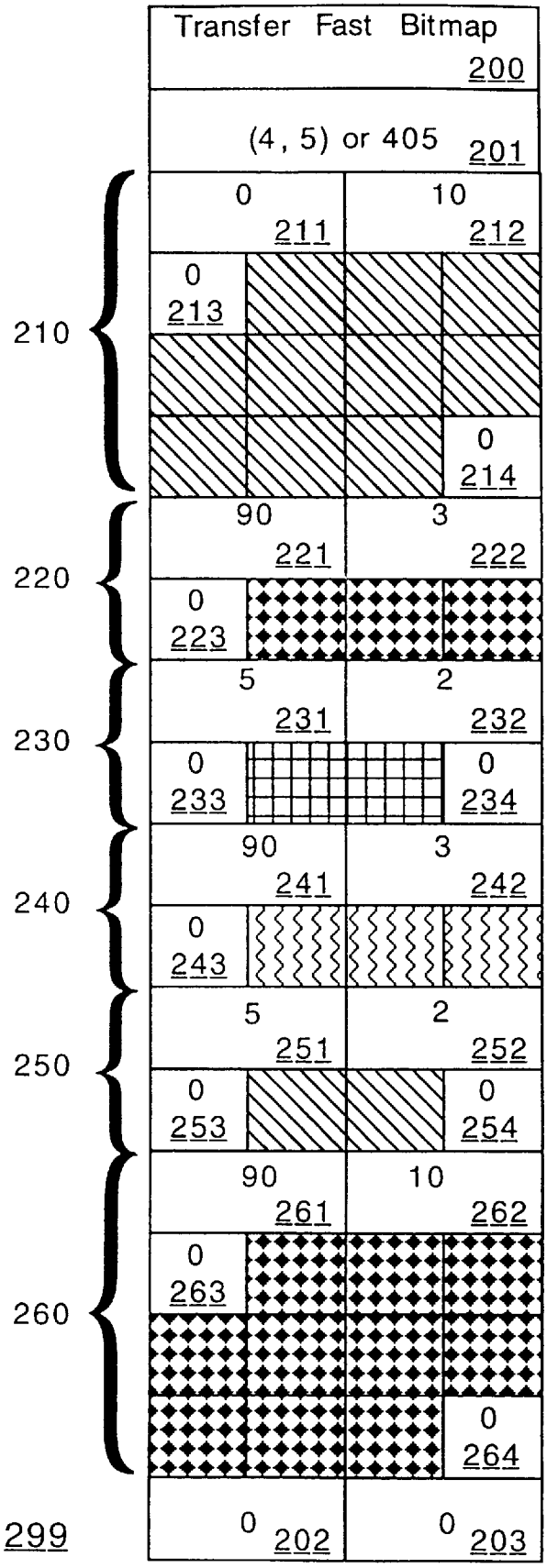
FIG. 2*b* shows the corresponding data structure that results in the display of the example bitmap when interpreted by the present invention.

FIG. 2*b* shows fast bitmap data structure 299 that represents the sprite or cockpit shown in FIG. 2*a*. Bitmap data structure 299 assumes a pixel depth of 8 bits, or 1 byte per pixel, and a word size of 32 bits per word. Each row in FIG. 2*b* represents a 32-bit word which may be divided into two 16-bit numerical values or into four 8-bit pixel values.

Bitmap data structure 299 starts with a command word, Transfer Fast Bitmap 200, which specifies that the information following is in the fast bitmap format. Typically, the present invention is used in a graphics system that also supports other commands and formats, for example, a traditional rectangular bitblit that writes every pixel within a rectangular region in display memory. Transfer Fast Bitmap 200 informs the graphics accelerator or the host software how to interpret the bitmap that follows. The transfer fast bitmap command occupies one 32-bit word of data structure 299.

The second word of bitmap 299, word 201, contains the initial pixel address at which the upper right corner of the bitmap is drawn. The initial address can be represented either as a row and column address, i.e. (4, 5), as a pixel count address, i.e. 405, or as a memory byte address which in this case is also 405 because data structure 299 is based on a one-byte-per-pixel display memory.

If the bitmap being displayed is a sprite that can be moved on the screen, then the sprite can be displayed at a different address simply by changing the value in word 201, provided that the new address has the same alignment of pixels within the display memory words.

If the bitmap being displayed is a stationary cockpit, then matching the alignment of pixels within bitmap words to the alignment of the target pixels within the display memory words is achieved statically at the time that the image data is compiled into a bitmap. For some cockpits, the pixel alignment within the bitmap that represents the cockpit will need to be adjusted to ensure meeting the alignment constraint imposed by the present invention.

After command word 200 and initial pixel address 201, bitmap data structure 299 partitions the pixels to be drawn into as many sets of contiguous pixels as are needed. The end of data structure 299 is indicated by flag values, such as zero, appearing where another repetition of a pixel offset or a pixel set size is expected.

Pixel set 210 as shown in FIG. 2*a* is the top row of the example bitmap. It is represented by four words within the bitmap data structure, as section 210 of bitmap 299, shown in FIG. 2b. The first word of section 210 is divided into first address offset 211 and first pixel set size 212. In the case of the example bitmap, first address offset 211 is 0 because initial pixel address 201 is the address at which the example bitmap is to be displayed. First pixel set size 212 is 10 because the top line of the example bitmap is 10 pixels long. In alternative embodiments of the invention, the address offset values and the pixel set sizes can be specified in either bytes or pixel counts. In the case of bitmap 299, these alternative representations produce identical bitmap data structures because there is one byte per pixel.

The remaining three words of section 210 are the pixel values for the top row of the example bitmap. They are aligned within the words of bitmap 299 in the same manner in which the target address (i.e., the address at which they will be written or drawn, or to which they will be transferred) is aligned within the words of the display memory.

In one embodiment of the invention, each line starts at a word boundary. Thus, pixel 5 within any line is located in the second pixel position of the second word of that line. When bitmap data structure 299 is interpreted, the contents of byte 213 are ignored, thus byte 213 is shown in FIG. 2*b* as a don't care value. Similarly, byte 214 is ignored and is shown as a don't care value. Thus, pixel set 210 shown in FIG. 2*a* is encoded in section 210 of bitmap data structure 299.

Similarly, the first set of pixels on the second row of the example bitmap is represented in section 220 of data structure 299. Subsequent address offset 221 specifies the number of pixels to skip, that is to leave unchanged because the example bitmap is transparent in those pixels. In this case, 90 pixels are skipped (one row minus 10 pixels). Subsequent pixel set size 222 specifies the length of pixel set 220 (i.e., how many contiguous pixels are to be drawn.) In this case, three pixels are to be drawn. Pixel data for these three pixels are given in the next word of section 220 of data structure 299. These pixel values are aligned with the word boundaries of the target pixels in the display memory, thus byte 223 is a don't care.

Subsequent address offset 231 of section 230 of data structure 299 specifies that five pixels are to skipped or left transparent before the next set of pixels to be modified. Subsequent pixel set size 232 specifies that two pixels are to be modified, thus forming the top line of the transparent region within the example bitmap. These pixel values are given by the second word of data structure section 230, which again is aligned with the word boundaries of the target pixels in the display memory, leaving bytes 233 and 234 as don't care.

Similarly, data structure section 240 specifies that 90 pixels are to be skipped, and that three pixels are to be written. The second word of data structure section 240 specifies the word aligned pixel values to be written. Data structure section 250 specifies that five transparent pixels are to be skipped before writing a set of two pixels, and has a second word containing the aligned pixel values to be written. Data structure section 260 specifies that 90 pixels are to be skipped in subsequent address offset 261, before writing 10 pixels in subsequent pixel set size 262. The word aligned pixel values to be written are given in the next three words of data structure segment 260.

Pixel set 260 completes the example bitmap. The end of the bitmap is shown in data structure 299 by a 0 value for subsequent pixel offset 202 and a 0 value for subsequent pixel set size 203 (i.e., a zero word).

Bitmap data structure 299 is significantly compressed over prior-art techniques based on rectangular bitblits, run-length encoding, or chroma key encoding. This compression occurs because the bitmap to be transferred is partitioned into set of contiguous pixels, each of which is separately addressed via offsets, i.e., via initial offset 211 and however many repetitions occur in the bitmap of subsequent offsets such as 221, 231, 241, 251, and 261. This compression of bitmap data structure increases graphics display performance.

Alignment of Pixel Data within Memory and Bitmap Words

FIG. 3 shows the possible alignments of 16-bit pixels and 8-bit pixels within 32-bit words. It will be clear to one skilled in the art that the alignment feature of the present invention is applicable with any word size and any pixel size, provided that a word contains 2 or more pixels.

Figure 3A:
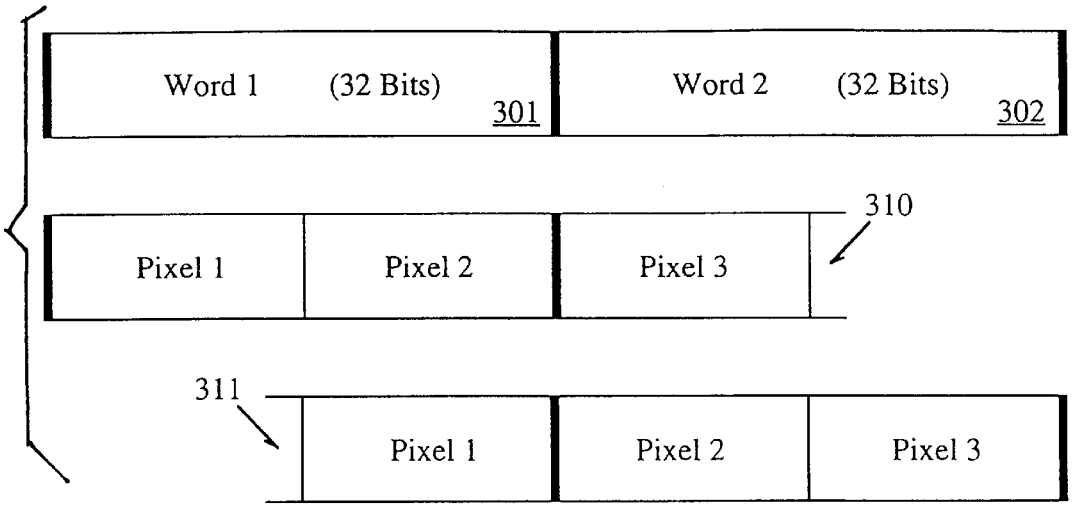
FIG. 3(*a*) shows the two possible alignments of a set of contiguous 16-bit pixels within a 32-bit display memory.

FIG. 3*a* shows the possible cases that arise when 16-bit pixels are packed into 32-bit words. Case 310 arises when the first pixel of a bitmap or pixel set happens to occupy the first 16 bits within a word. Case 311 arises when the first pixel within a bitmap or set occupies the second 16 bits within a word. Cases 310 and 311 are the only two possibilities for 16-bit pixels packed into 32-bit words.

Figure 3B:
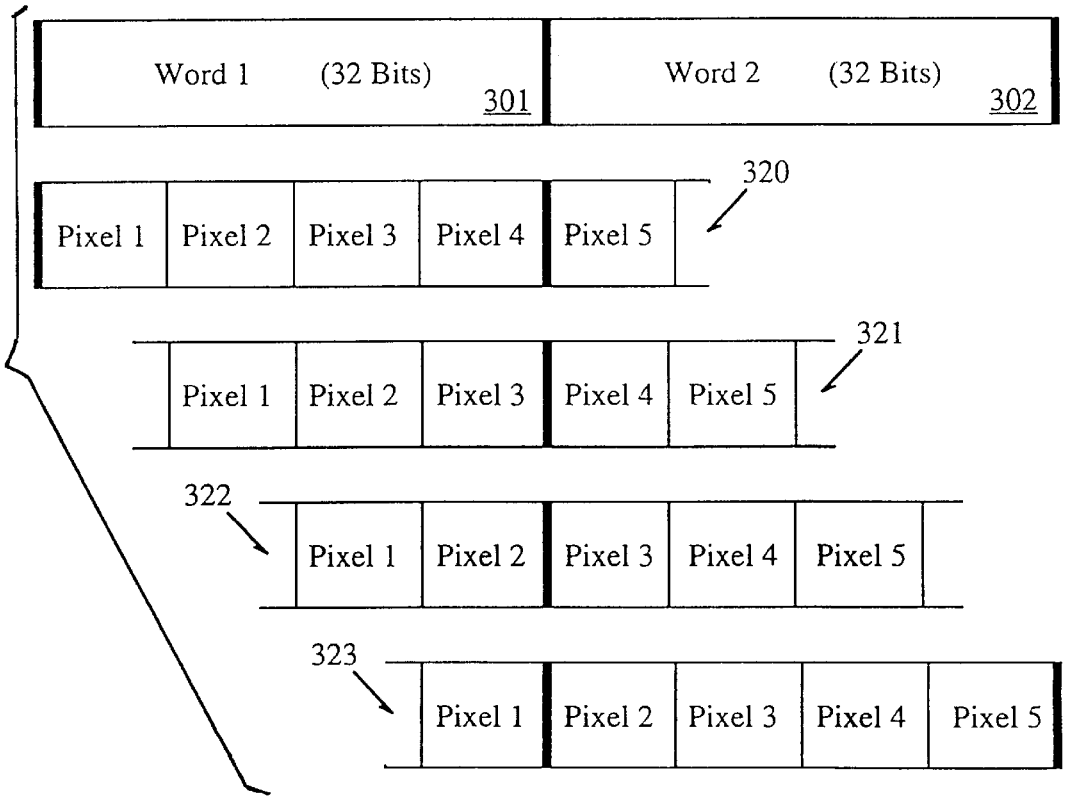

FIG. 3*b* shows the possible cases when 8-bit pixels are packed into a 32-bit word. Case 320 arises when the first pixel of a bitmap or pixel set happens to align with the start of the 32-bit word. In case 320, the first word contains the first four pixels of the pixel set, and pixel five starts the second word.

Case 321 arises where the first pixel of the pixel set is the second pixel within word 1 301. In case 320, pixels one, two, and three are the last pixels within the first word, and pixels four and five are the first pixels within word 2 202.

Similarly, case 322 arises where the first pixel of a pixel set is the second pixel within a word. In this case, word 301 contains pixel one and pixel two as its last two pixels, and word 302 contains pixels three, four, and five as its first three pixels.

Case 323 arises where the first pixel of a pixel set is the last pixel within a word. In case 323, word 301 contains pixel one as its last pixel, and word 302 contains pixels two to five. Cases 320, 321, 322, and 323 are the only cases that can arise when 8-bit pixels are packed into 32-bit words.

Software Dynamically Selects Among Sprite Bitmap Versions

Figure 4:
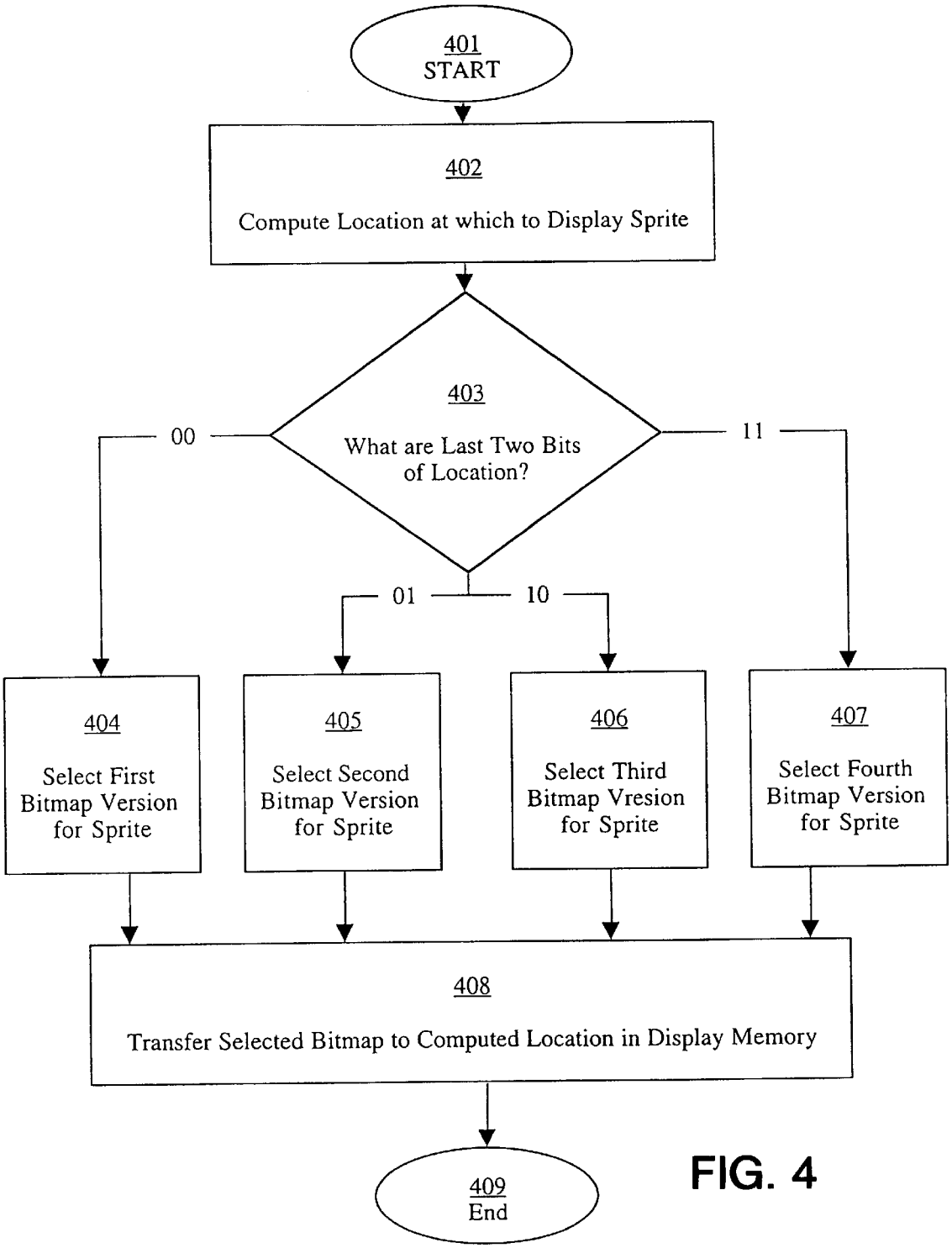
FIG. 4 shows the steps that application software, such as a computer game, must perform in order to select which bitmap version to transfer to the graphics accelerator depending on the current location of a moving sprite.

FIG. 4 is a flowchart describing the procedure used by application software, such as a game, to dynamically select which version of a bitmap is used for a sprite. This applications software would typically execute on a host CPU processor, such as CPU 601 shown in FIG. 6.

The procedure shown in FIG. 4 assumes that the sprite can move to any location on the screen and that four 8-bit pixels are packed into each 32-bit word in display memory. Given these conditions, four bitmap versions are required, which correspond to cases 320, 321, 322, and 323 shown in regard to FIG. 3. If a sprite could only be drawn at every other pixel position, or if 16-bit pixels were packed into a 32-bit word, then only two bitmap versions would be required to represent the sprite.

The procedure starts 401 by computing the location at which the sprite is to be displayed (step 402). Next, the least significant two bits of the location computed are tested (step 403). This test transfers control to four different steps depending on the four different possible values for these two bits—which one of steps 404, 405, 406, or 407 receives control depends on the value in the last two bits of the computed location.

Each of these steps selects the corresponding bitmap version for the sprite as the one to be used for this location. The four different bitmap versions differ only in the word alignment of the pixel data represented in each version. Each of these steps then transfers control to step 408, which writes or transfers the selected bitmap version to the location computed within display memory. This ends 409 the procedure.

Stationary Cockpits Must Be Pre-aligned when Compiled

According to the present invention, even stationary bitmaps, or cockpits, are required to be pixel aligned with respect to the target display memory words. If the bitmap is stationary, only one version of it is required, but that version must be pre-aligned at the time that the application's software or its data files are compiled. If the "natural" alignment of the bitmap, i.e. with no leading don't-care pixels, does not provide the word alignment required, then the bitmap's alignment must be adjusted when the bitmap is compiled.

Graphics Accelerator Architecture

Figure 5:
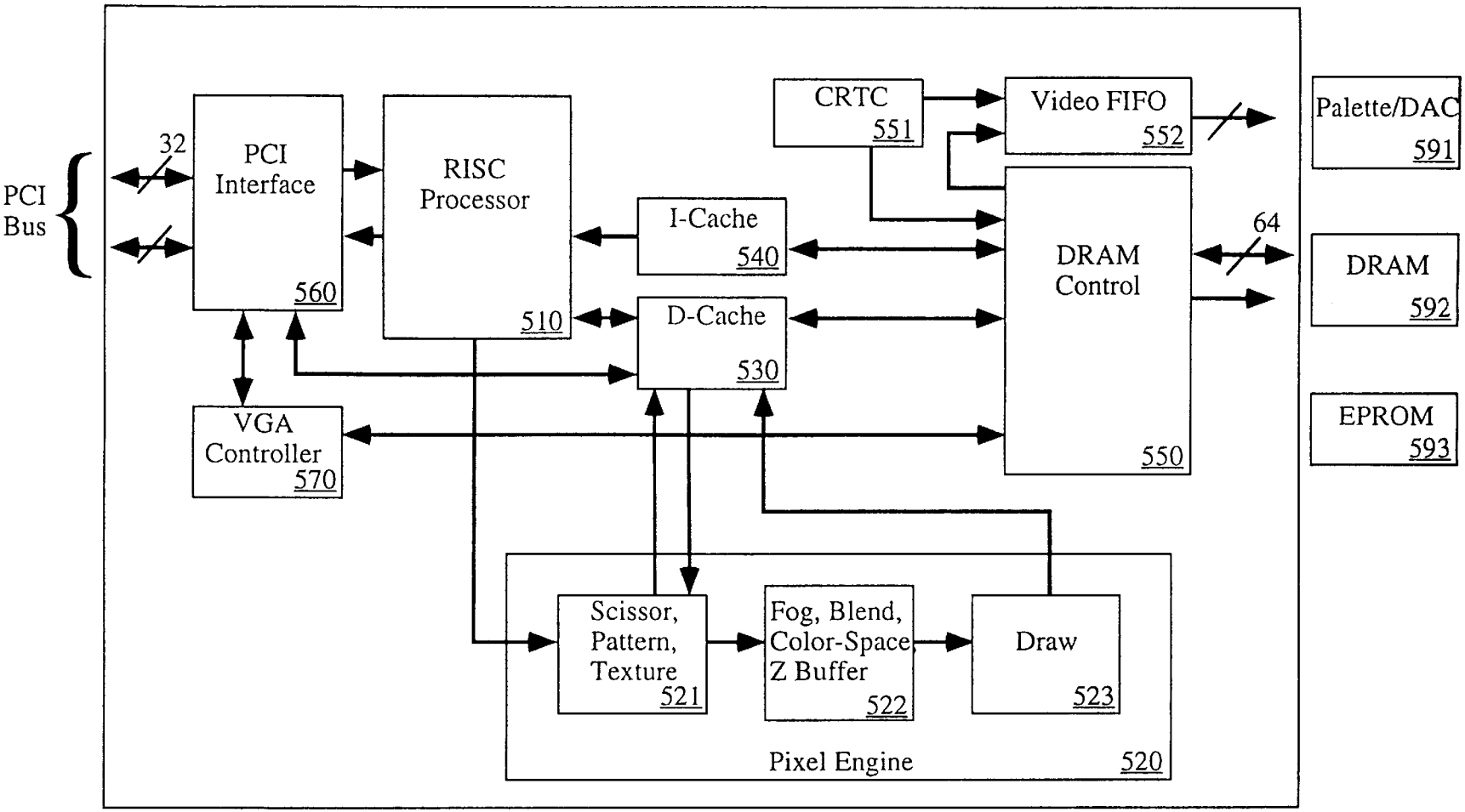
FIG. 5 shows the major components within a graphics accelerator that can implement the present invention.

FIG. 5 shows the architecture of graphics accelerator 500 used in one embodiment of the present invention. Graphics accelerator 500 receives fast bitmap data structures, such as data structure 299 shown in FIG. 2, from a PCI bus (not shown) via PCI interface 560.

PCI interface 560 decides whether the information received from the PCI bus is a graphics accelerator command to be interpreted by RISC processor 510, or if it is a video graphics array (VGA) command to be interpreted by VGA controller 570.

VGA controller 570 provides compatibility with VGA-based software operating on the host CPU. While VGA controller 570 is not essential to the operation of the present invention, it enhances the cost-effectiveness of graphics accelerator 570.

The performance of RISC processor 510 is enhanced by instruction cache 540 and data cache 530, as is well-known in the art. RISC processor 510 interprets various graphics accelerator commands based on a microinstruction file stored in electronically programmable read-only memory (EPROM) 593 available to RISC processor 510 via instruction cache 540 and dynamic random access memory (DRAM) control 550.

The commands interpreted by RISC processor 510 include the transfer fast bitmap command of the present invention. RISC processor 510 also calls on pixel engine 520, which include scissor, pattern and texture circuitry 521, fog blend, color space, and Z buffer circuitry 522, and drawing circuitry 523 to transform information relating to a certain pixel at high speeds.

Cathode ray tube (CRT) controller (CRTC) 551, video first in first out (FIFO) 552, and digital-to-analog converter (DAC) 591 are well-known in the art.

Dynamic Read-Only Memory (DRAM) 592 holds the frame buffer or display memory that holds the pixel values to be displayed. Typically, DRAM 592 is larger than is required for the current pixel values displayed, which are taken from a window within DRAM 592. The present invention does not involve any transfers of pixel data within DRAM 592, because such transfers always require two access cycles of DRAM 592 per word transferred, whereas transfers from the PCI bus into DRAM 592 only require one, except at the end of a set of contiguous pixels where, depending on pixel alignment, a read-modify-write cycle of DRAM 592 may be required.

Computer System Architecture with Graphics Accelerator

Figure 6:
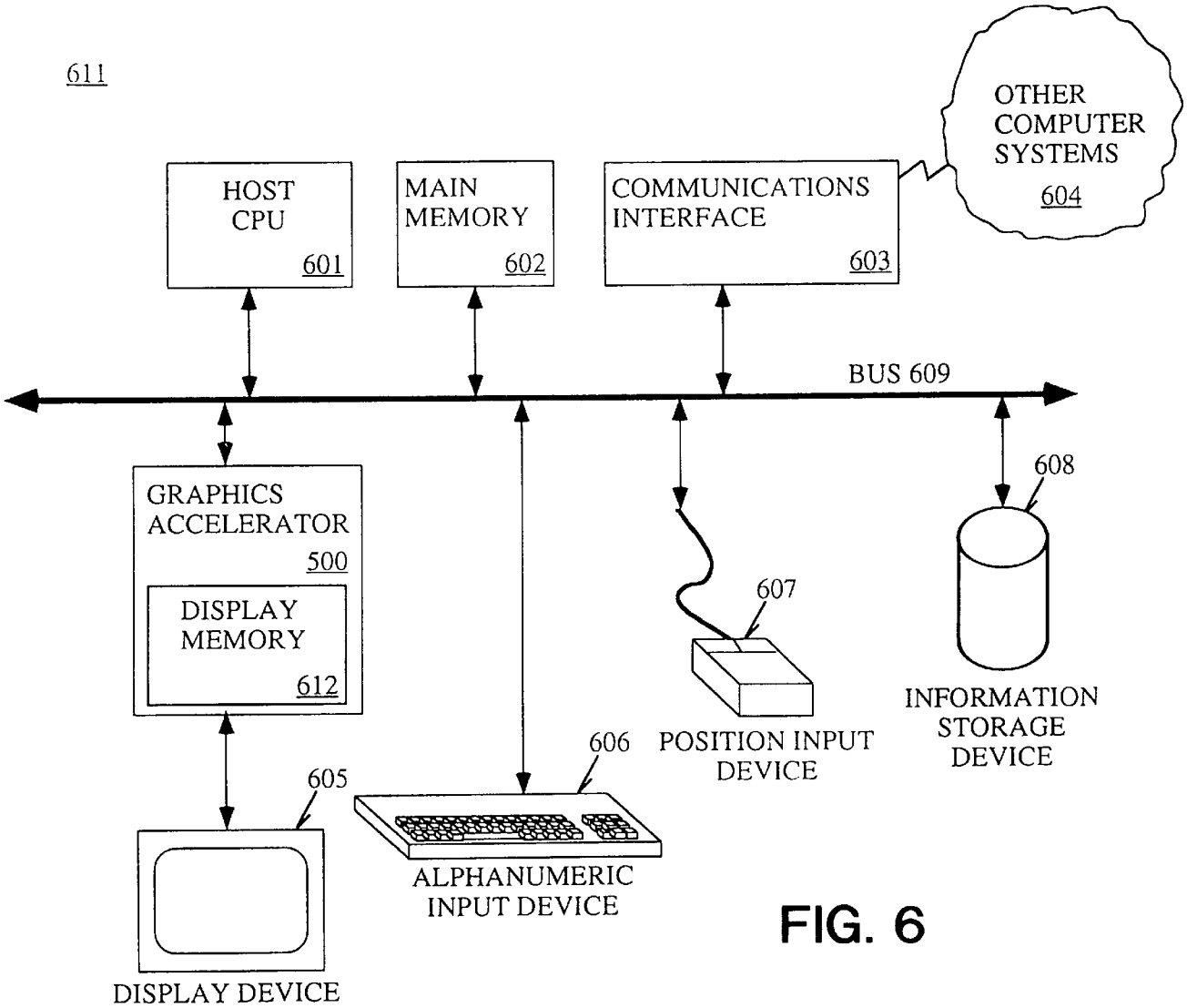
FIG. 6 shows the major components within a computer system that uses of the present invention.

FIG. 6 is an architectural block diagram of an example programmable computer system 611 within which various embodiments of the present invention can operate.

Computer system 611 typically comprises a bus 609 for communicating information, such as instructions and data. In one embodiment of the present invention, bus 609 is a PCI bus. Computer system 611 further typically comprises a host central processing unit (CPU) 601, coupled to bus 609, for processing information according to programmed instructions, a main memory 602 coupled to bus 609 for storing information for host CPU 601, and a data storage device 608 coupled with bus 609 for storing information. In the case of a desk-top design for computer system 611, the above components are typically located within a chassis (not shown).

Host CPU 601 could be a 386, 486 Pentium® or compatible processor made by Intel Corp., among others. Main memory 602 could be a random access memory (RAM) to store dynamic information for host CPU 601, a read-only memory (ROM) to store static information and instructions for host CPU 801, or a combination of both types of memory.

In alternative designs for computer system 611, data storage device 608 could be any medium for storage of computer readable information. Suitable candidates include a read-only memory (ROM), a hard disk drive, a disk drive with removable media (e.g. a floppy magnetic disk or an optical disk), or a tape drive with removable media (e.g. magnetic tape), or a flash memory (i.e. a disk-like storage device implemented with flash semiconductor memory). A combination of these, or other devices that support reading or writing computer readable media, could be used.

The input/output devices of computer system 611 typically comprise display device 605, alphanumeric input device 606, position input device 607 and communications interface 603, each of which is coupled to bus 609. If data storage device 608 supports removable media, such as a floppy disk, it may also be considered an input/output device. Communication interface 603 communicates information between other computer systems 604 and host CPU 601 or main memory 602.

Alphanumeric input device 606 typically is a keyboard with alphabetic, numeric and function keys, but it may be a touch sensitive screen or other device operable to input alphabetic or numeric characters.

Position input device 607 allows a computer user to input command selections, such as button presses, and two dimensional movement, such as of a visible symbol, pointer or cursor on display device 605. Position input device 607 typically is a mouse or trackball, but any device may be used that supports signaling intended movement of a user-specified direction or amount, such as a joystick or special keys or key sequence commands on alphanumeric input device 606. Display device 605 may be a liquid crystal display, a cathode ray tube, or any other device suitable for creating graphic images or alphanumeric characters recognizable to the user.

In the embodiment of the present invention shown in FIG. 6, display device 605 is controlled by graphics accelerator 500 as shown in FIG. 5. Graphics accelerator 500 contains within it display memory 612 that holds the values for the pixels being displayed on display device 605.

Graphics accelerator 500 is operable to quickly perform, execute, or interpret various commands that operate upon, change, or transform the pixel values. For example, it interprets bitmap data structure 299 and modifies the pixel values in display memory 612. If the initial or the final pixels within each set of contiguous pixels within a fast bitmap do not align with the memory word boundaries, then host CPU performs a read-modify-write cycle. This leaves those pixels where the bitmap is transparent unmodified.

It will be clear to one skilled in the art that the present invention can operate within a wide range of programmable computer systems, not just example computer system 611.

Software Embodiment of the Present Invention

An alternative embodiment of the present invention (not shown) omits graphics accelerator 500. Rather, host CPU 601 directly controls, manipulates, and manages the pixel data within display memory 612. The contents of the current display window within display memory 612 are shown on display device 605.

Software executing on host CPU 601 would, for example, interpret bitmap data structure 299 and modify the pixel values in display memory 612 accordingly. If the initial or the final pixels within each set of contiguous pixels within a fast bitmap do not align with the memory word boundaries, then host CPU performs a read-modify-write cycle. This leaves those pixels where the bitmap is transparent unmodified.

Compared to the embodiment shown in FIG. 6, the software embodiment is lower in cost, but consumes more of the host CPU's bandwidth and processing power. Compared to the prior art discussed above, this alternative software embodiment has higher performance.

Conclusion

As illustrated herein, the present invention provides a novel and advantageous method and apparatus for high-speed block transfer of compressed and word-aligned bitmaps. One skilled in the art will realize that alternative embodiments, design alternatives and various changes in form and detail may be employed while practicing the invention without departing from its principles, spirit or scope. For example, a wide range of alternative designs exist for bitmap data structure 299 and for graphics accelerator 500.

The following claims indicate the scope of the present invention. Any variation which comes within the meaning of, or the range of equivalency of, any of these claims is within the scope of the present invention.

What is claimed is:

1. A method for displaying an image comprising pixels, the method comprising the steps of:

compiling information relating to an image into a bitmap, wherein a bitmap comprises multiple words and each word comprises multiple sets of multi-bit pixel values, each pixel value indicating how a pixel is displayed;

transferring the information to a device for the purpose of modifying the information, wherein the device includes an addressable storage area for the information;

aligning the bitmap such that word boundaries within each pixel value of a set of contiguous pixels matches word boundaries of the storage area;

if the image is a static image, performing alignment when the information is compiled into a bitmap, where the information is compiled by compiling non-bitmap sources selected from the group consisting of application software and application data files;

if the image is a dynamic image, compiling multiple bitmap versions such that the multiple versions comprise a bitmap for each possible alignment; and using a current displayed location of the dynamic image to select one of the bitmap versions to transfer.

2. The method of claim 1, wherein the device is a frame buffer.

3. The method of claim 1, wherein the device is a display memory.

4. The method of claim 1, wherein not every pixel value of the information is modified when the information is modified, the method further comprising the steps of:

performing a count of pixel values not to be modified; and transferring the count to the device, such that only pixel values to be modified are transferred.

5. In a system that includes a graphics display, a method for transferring a bitmap to a memory of a display device, the method comprising the steps of:

selecting the bitmap to be transferred based on a word alignment within the memory;

compressing pixel data of the bitmap, wherein compressing pixel data includes determining pixels that are not to be modified;

aligning the bitmap such that word boundaries of the bitmap match word boundaries of the memory; and if an image to be displayed using the bitmap is a static image, performing alignment when the bitmap is compiled, where the bitmap is compiled by compiling non-bitmap sources selected from the group consisting of application software and application data files.

6. The method of claim 5, further comprising the step of, if an image to be displayed is a dynamic image, compiling multiple bitmap versions such that the multiple versions comprise a bitmap for each possible alignment.

7. The method of claim 6, further comprising the step of using a current displayed location of the dynamic image to select one of the bitmap versions to transfer.

8. The method of claim 5, wherein aligning the bitmap includes aligning the bitmap such that word boundaries within each pixel value of a set of contiguous pixels matches word boundaries of the memory.

9. A system for displaying an image comprising pixels, comprising:

a graphics device coupled to a bus;

a memory coupled to the graphic device, wherein the memory stored graphics data in bitmaps;

a display device coupled to the graphics device; and a processor coupled to the bus, wherein the processor compiles bitmaps and transfers the bitmaps to the memory, where the processor compiles the bitmaps by compiling non-bitmap sources selected from the group consisting of application software and application data files, and wherein when a bitmap is for a dynamic image, multiple bitmap versions of the image are compiled such that the multiple versions comprise a bitmap for each possible alignment.

10. The apparatus of claim 9, wherein the processor further uses a current displayed location of the dynamic image to select one of the bitmap versions to transfer.

11. An apparatus to display an image comprising pixels, comprising:

a memory accessible by words and having addresses corresponding to pixels, operable to hold at each said pixel address a value indicating how the corresponding pixel is displayed; and a processor operable to modify said pixel values within said memory according to an initial pixel address and a bitmap, said bitmap comprising:

a) a first address offset;

b) a first pixel set size, which is non-zero;

c) pixel values for a first set of pixels, the length of said first pixel set being indicated by said first pixel set size, the start of said first pixel set being addressed by said initial pixel address and said first address offset, and the word boundaries within said first pixel set in said bitmap being aligned with the word boundaries within the corresponding pixel set in said memory;

d) a subsequent address offset, which is non-zero;

e) a subsequent pixel set size, which is non-zero; and f) pixel values for a subsequent set of pixels, the length of said subsequent pixel set being indicated by said subsequent pixel set size, the start of said subsequent pixel set being incrementally addressed by said subsequent address offset, and the word boundaries of said subsequent pixel set within said bitmap being aligned with the word boundaries within the corresponding pixel set in said memory.

12. The apparatus according to claim 11, wherein said bitmap further comprises at least one more repetition of said subsequent address offset, said subsequent pixel set size and said subsequent pixel values.

13. The apparatus according to claim 12, wherein the end of said repetitions is indicated by the value of said subsequent address offset being a flag value.

14. The apparatus according to claim 12, wherein the end of said repetitions is indicated by the value of said subsequent pixel set size being a flag value.

15. The apparatus according to claim 11, further comprising:

a user input device operable to provide indications of user input;

a storage device operable to hold said bitmap; and a central processing unit operable to receive said user input indications from said user input device and said bitmap from said storage device, and to provide said bitmap to said processor.

16. The apparatus according to claim 11, further comprising:

a user input device operable to provide indications of user input; and a storage device operable to hold said bitmap;

wherein said processor is further operable to receive said user input indications from said user input device and said bitmap from said storage device.

17. The apparatus according to claim 11, further comprising:

a central processing unit operable to execute software comprising a plurality of bitmaps differing in their word alignment, said software selecting which of said plurality of bitmaps said processor operates on based on the word alignment in said memory of the pixels being modified according to said bitmap.

18. The apparatus according to claim 11, wherein said processor is further operable to execute software comprising a plurality of bitmaps differing in their word alignment, said software selecting which one of said plurality of bitmaps to operate on based on the word alignment in said memory of the pixels being modified according to said plurality of bitmaps.

19. The apparatus according to claim 11, wherein the pixel alignment of said bitmap is adjusted when said bitmap is compiled such that the word boundaries of the pixel sets within said bitmap align with the word boundaries of the corresponding pixel sets in said memory.

20. A method of displaying an image comprising pixels, comprising:

displaying pixels according to the pixel value at the address in a memory that corresponds to each said pixel; and processing a bitmap to modify said pixel values within said memory according to said bitmap, said bitmap comprising:

a) a first address offset;

b) a first pixel set size, which is non-zero;

c) pixel values for a first set of pixels, the length of said first pixel set being indicated by said first pixel set size, the start of said first pixel set being addressed by said initial pixel address and said first address offset, and the word boundaries within said first pixel set in said bitmap being aligned with the word boundaries within the corresponding pixel set in said memory;

d) a subsequent address offset, which is non-zero;

e) a subsequent pixel set size, which is non-zero; and f) pixel values for a subsequent set of pixels, the length of said subsequent pixel set being indicated by said subsequent pixel set size, the start of said subsequent pixel set being incrementally addressed by said subsequent address offset, and the word boundaries within said subsequent pixel set in said bitmap being aligned with the word boundaries within the corresponding pixel set in said memory.

21. The method according to claim 20, wherein said bitmap further comprises at least one more repetition of said subsequent address offset, said subsequent pixel set size and said subsequent pixel values.

22. The method according to claim 20, wherein the end of said repetitions is indicated by the value of said subsequent address offset being a flag value.

23. The method according to claim 20, wherein the end of said repetitions is indicated by the value of subsequent pixel set size being a flag value.

24. The method according to claim 20, further comprising:

a user input device providing indications of user input;

a storage device providing said bitmap; and a central processing unit receiving said user input indications from said user input device and said bitmap from said storage device, and providing said bitmap to said processor.

25. The method according to claim 20, further comprising:

a user input device providing indications of user input; and a storage device providing said bitmap;

said processor receiving said user input indications from said user input device and said bitmap from said storage device.

26. The method according to claim 20, further comprising:

selecting which of a plurality of bitmaps is processed based on the word alignment in said memory of the pixels being modified according to said plurality of bitmaps, said plurality of bitmaps differing in their word alignment.

27. The method according to claim 20, wherein the pixel alignment of said bitmap was adjusted when said bitmap was compiled such that the word boundaries of the pixel sets within said bitmap align with the word boundaries of the corresponding pixel sets in said memory.

28. A method of displaying an image comprising pixels, comprising:

displaying pixels according to the pixel value at the address in a memory that corresponds to each said pixel; and modifying said pixel values in said memory according to a bitmap comprising initial address information and pixel values for at least two sets of pixels, said modification comprising, for each set of pixel values in said bitmap:

a) determining the word address in said memory of the first pixel in the current pixel set and its position within said first word;

a) determining the word address in said memory of the last pixel in the current pixel set and its position within said last word;

b) if said first pixel is not the first pixel within said first word, then reading from said memory the pixels that precede said first pixel within said first word, modifying said first word to replace said first pixel and any subsequent pixels within said first word with the values of the corresponding bit positions of the corresponding word within said bitmap, and writing said modified first word back to said memory;

c) writing words from said bitmap into said memory until the word containing said last pixel is about to be written;

d) if said last pixel is the last pixel within said last word, then writing said last word with the corresponding word from said bitmap;

e) if said last pixel is not the last pixel within said last word, then reading from said memory the pixels that follow said last pixel within said last word, modifying said last word to replace said last pixel and any preceding pixels within said last word with the values of the corresponding bit positions of the corresponding word within said bitmap, and writing said modified last word back to said memory.

* * * * *